US008022976B2

(12) United States Patent
Lund et al.

(10) Patent No.: US 8,022,976 B2
(45) Date of Patent: Sep. 20, 2011

(54) LASER POWER SWITCHING FOR ALIGNMENT PURPOSES IN A LASER PRINTER

(75) Inventors: Mark Edwin Kirtley Lund, Lexington, KY (US); Eric Wayne Westerfield, Versailies, KY (US)

(73) Assignee: Lexmark International, Inc., Lexington, KY (US)

( * ) Notice: Subject to any disclaimer, the term of this patent is extended or adjusted under 35 U.S.C. 154(b) by 1467 days.

(21) Appl. No.: 11/422,605

(22) Filed: Jun. 7, 2006

(65) Prior Publication Data

US 2007/0285492 A1 Dec. 13, 2007

(51) Int. Cl.
*B41J 2/435* (2006.01)
*B41J 2/47* (2006.01)

(52) U.S. Cl. ..... 347/246; 347/236; 347/237; 347/247; 347/253

(58) Field of Classification Search ..... 347/236, 347/246, 239, 237, 247, 253
See application file for complete search history.

(56) References Cited

U.S. PATENT DOCUMENTS

| | | | | |
|---|---|---|---|---|
| 5,264,871 | A | 11/1993 | Tsukada | |
| 5,710,589 | A * | 1/1998 | Genovese | 347/262 |
| 6,583,913 | B2 * | 6/2003 | Ito et al. | 359/204.1 |
| 2003/0213890 | A1 * | 11/2003 | Mochiduki et al. | 250/205 |

* cited by examiner

*Primary Examiner* — Stephen D Meier
*Assistant Examiner* — Sarah Al-Hashimi

(57) ABSTRACT

An apparatus for switching and controlling the intensity of a laser beam directed toward a beam detect sensor for an image forming device. A printing power reference signal and a beam detect power reference signal is selectively connected to a laser driver through a first switch. A printing power reference holding capacitor and a beam detect power reference holding capacitor is selectively connected to the laser driver through a second switch that is controlled in tandem with the first switch. During each scan cycle, the output laser power is monitored and used to adjust one of the two holding capacitors based such that both the printing power and the beam detect power have a controlled reference.

19 Claims, 6 Drawing Sheets

LASER POWER SWITCHING FOR ALIGNMENT PURPOSES IN A LASER PRINTER

FIELD

The disclosure relates to switching of laser power in a laser printer, and in particular, to the control and switching of laser power for both imaging and beam detecting to ensure alignment between color planes and/or bi-directional scan lines.

BACKGROUND

In an image forming apparatus, such as a laser printer, a laser beam is swept, or scanned, across a photosensitive device. The accurate and precise placement of the swept laser beam ensures that the resulting output from the image forming apparatus is an accurate representation of the desired image.

It is also desirable to accurately control laser beam intensity, and one technique for doing so is found in U.S. Pat. No. 5,264,871, titled "Image forming apparatus having light beam intensity switching for detection purposes," issued to Tsukada on Nov. 23, 1993. It discloses an image forming device with a beam detect sensor 31 that provides timing and position information for the laser beam 7. The Tsukada patent addresses the problem in which the laser power is changed to correspond with a selected pixel density and that same laser power level is used by the beam detect sensor 31. The Tsukada patent discloses an apparatus for switching the laser beam intensity to correspond to a position of a pixel density selection switch.

SUMMARY

An apparatus is disclosed for maintaining the intensity of a laser beam directed toward a beam detect sensor at a constant level regardless of the intensity of the laser beam when it is at positions other than the beam detect position. A laser driver receives a reference power level signal from and output of a first switch. The first, or reference power, switch has two inputs, one for the printing power reference signal and another for the beam detect power reference signal. The switch selects the input based upon a power select signal. The laser driver is also connected to a second switch. The second switch has two inputs, each connected to a holding capacitor. The switch is controlled by the same power select signal that controls the first switch. One of the holding capacitors corresponds to a reference level for the printing power and the other holding capacitor corresponds to a reference level for the beam detect power. The laser driver receives an adjust signal, which includes timing information for the laser driver to output a signal to the appropriate holding capacitor.

In operation, the printing power reference capacitor is set, or adjusted, every other scan cycle. The beam detect power reference capacitor is set, or adjusted, at every other scan cycle when the printing power reference is not being set. The laser driver uses the respective holding capacitor voltage, in combination with the reference power level signal, to ensure that the proper power level of the laser is maintained.

BRIEF DESCRIPTION OF THE DRAWINGS

Further features and advantages of the disclosed embodiments may become apparent by reference to the detailed description when considered in conjunction with the figures, which are not to scale, wherein like reference numbers indicate like elements through the several views, and wherein.

DETAILED DESCRIPTION

An apparatus for maintaining the intensity of a laser beam directed toward a beam detect sensor at a constant, predetermined level regardless of the intensity of the laser beam when it is at other positions than the beam detect position is disclosed.

Figure 1:
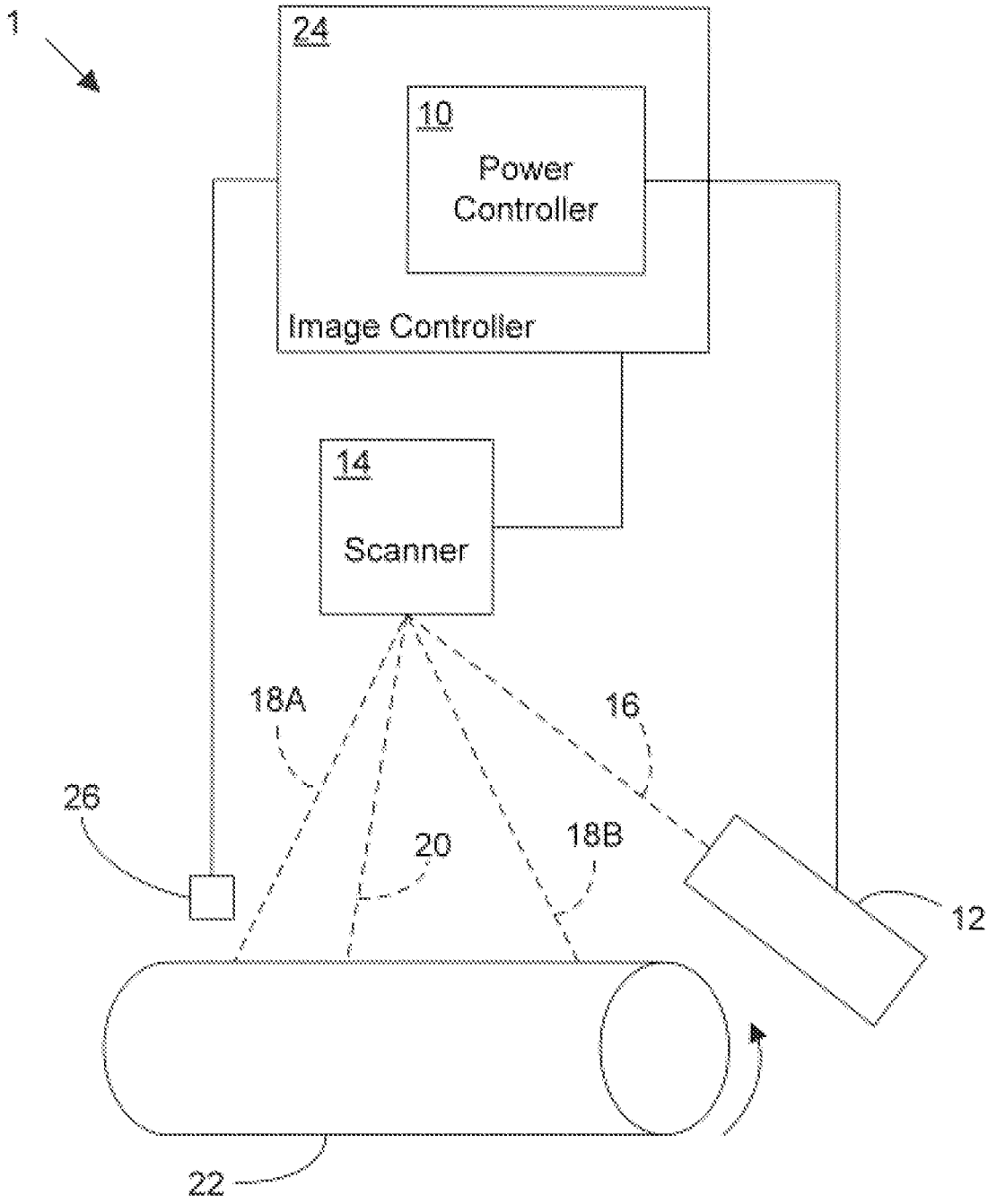
FIG 1. is a simplified schematic of a laser scanning unit.

FIG. 1 illustrates a simplified schematic of a laser scanning unit 1. A laser unit 12 directs a stationary laser beam 16 toward a scanner 14. The intensity of the laser beam 16 is controlled by the image controller 24. The scanner 14 is a device that reflects the stationary laser beam 16 toward a photosensitive drum 22. In various embodiments, the scanner 14 is a rotating polygonal reflector or an oscillating reflector, such as a torsion oscillator, In various embodiments, the laser scanning unit 1 may include one or more redirection mirrors and one or more lenses, such as an f-theta lens.

The reflected laser beam 20 is caused by the scanner 14 to sweep between a first boundary 18A and a second boundary 18B in order to follow a scan path on the photosensitive drum 22. The drum 22 rotates such that each scan path is physically separated from the previous scan path by the amount of rotation of the drum 22. The scanner 14 also causes the reflected laser beam 20 to extend past one boundary 18A and to strike a beam detect sensor 26. The beam detect sensor 26 provides a signal to the image controller 24. The image controller 24 includes the circuits and components necessary for the operation of the laser scanning unit 1, including a power controller 10.

The power controller 10 provides control of the laser 12 such that the intensity of the laser beam 16 is controlled and the beam detect sensor 26 receives a light beam 20 at a desired intensity for the generation of an accurate horizontal sync signal 34.

Figures 2A, 2B, 2C:
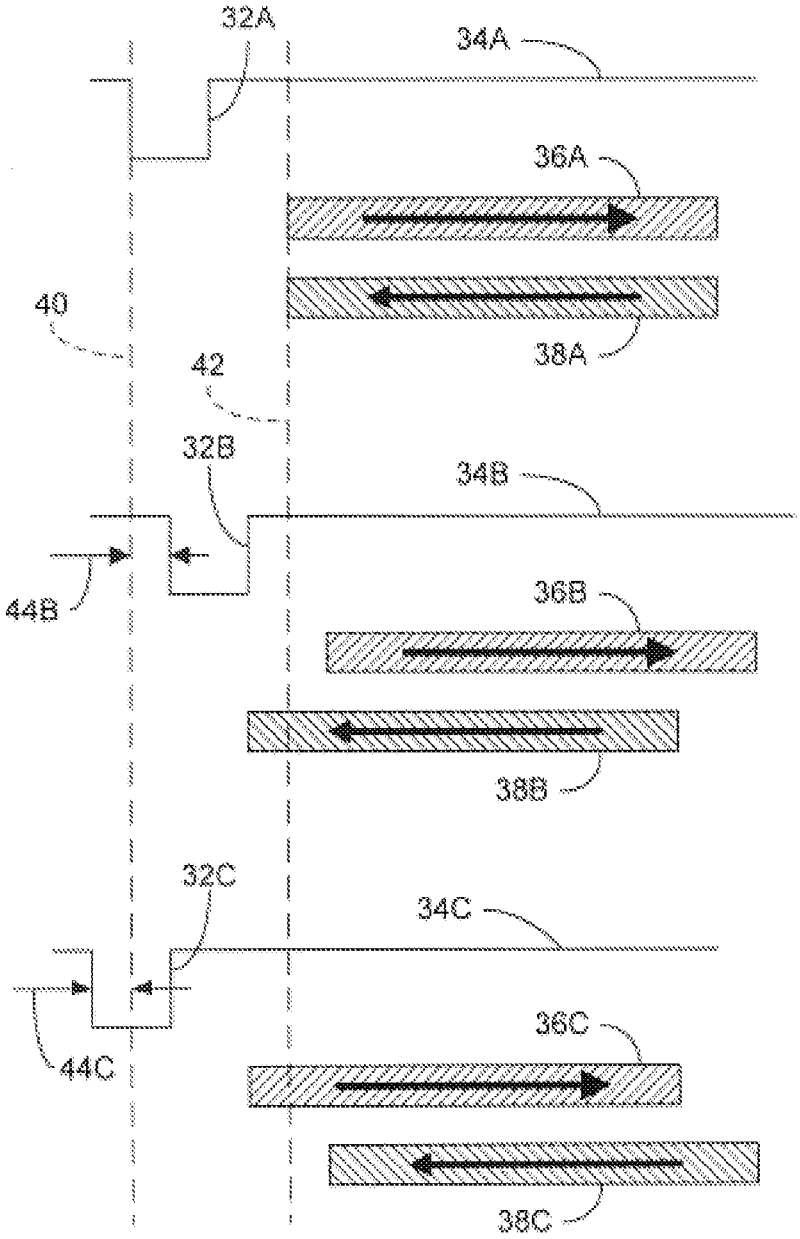
FIGS. 2A, 2B, and 2C are not-to-scale exaggerated charts illustrating the timing relationships between a horizontal sync signal and a forward scan and a reverse scan of the laser.

FIGS. 2A, 2B, and 2C are charts illustrating the timing/spatial relationships between a fixed, specified point 40 corresponding to a desired position of the laser beam 20, a horizontal sync signal 34, and a forward scan 36 and a reverse scan 38 of the laser beam 20. Laser scanning units 1 for some types of color laser printers required multiple scanning plans. Also, laser scanning units 1 for some types of black-and-white laser printers required bi-directional scanning in which the sweeping laser beam 20 interacts with the photosensitive drum 22 in a forward scan 36 and a reverse scan 38. A color laser printer requires alignment between different color planes. A bi-directional printer requires alignment between the forward and reverse scans. The embodiment illustrated in FIGS. 1, 2A, 2B, and 2C illustrates a bi-directional printer where the reflected laser beam 20 sweeps back and forth between the two boundaries 18A, 18B and each pass, or scan, 36, 38 of the laser beam 20 interacts with the photosensitive drum 22. FIGS. 2A-2C are not-to-scale and are exaggerated in the time and distanced dimensions to illustrate the embodiment. For the graphs illustrating pulses 32A, 32B, and 32C, the horizontal dimension represents time and the vertical dimension represents voltage. In the illustrations of the laser scan 36A-36C, and 38A-38C, the horizontal dimension represents the physical position of the laser beam 20 on the drum 22. The scans 36A-36C and 38A-38C are superimposed on the graphs of pulse 32A-32C to illustrate the effects of power on the timing and position of the laser beam 20.

FIG. 2A illustrates a horizontal sync signal 34A that has a sync pulse 32A with a leading edge that coincides with the laser beam 20 striking the beam detect sensor 26 with the laser beam 20 sweeping at a specified point 40. The specified point 40 coincides with a specified time and position of the laser beam 20 and is a reference point for the forward and reverse scans 36, 38. With the laser beam 16 controlled at a predetermined intensity, the beam detect sensor 26 consistently produces a signal such that the horizontal sync pulse 32A will start when the sweeping laser beam 20 sweeps past the specific point 40.

A predetermined amount of time after the leading edge of horizontal sync signal 32A, the forward scan 36A of the image data begins. After the sweeping laser beam 20 changes direction, the reverse scan 38A begins at a predetermined time and continues for specified distance. In order for the resulting image to be properly reproduced, the starting position 42 of the forward scan 36A and the ending position 42 of the reverse scan 38A must coincide physically on the photosensitive drum 22. Likewise, the ending position of the forward scan 36A and the starting position of the reverse scan 38A must coincide physically on the photosensitive drum 22. Such is the case illustrated in FIG. 2A. The forward scan 36A and the reverse scan 38A are aligned.

FIG. 2B illustrates the case in which the intensity of the laser beam 20 is less than the predetermined intensity. The beam detect sensor 26 includes a photodetector with a window through which the laser beam 20 passes. At less than the predetermined desired intensity, the laser beam 20 must expose the photodetector for a longer period of time than the desired condition illustrated in FIG. 2A. which means that the laser beam 20 travels a greater distance before the beam detect sensor 26 provides the appropriate signal to the image controller 24. Because of the greater distance the beam 20 travels along the sweep, the horizontal sync pulse 34B is generated at a later time. The difference in position is illustrated in FIG. 2B by the gap 44B between the specified point 40 and the leading edge of the horizontal sync pulse 32B. The horizontal sync pulse 32B starting at a later time results in the forward scan 36B being displayed away from the specified point 40. Because the forward scan 36B starts late, the reverse scan 38B also starts late, as depicted by the reverse scan 38B shown shifted to the left in FIG. 2B. Accordingly, the forward scan 36B and the reverse scan 38B are not aligned, thereby degrading the resulting image.

FIG 2C illustrates the case in which the intensity of the laser beam 20 greater than the predetermined intensity. With greater intensity, the laser beam 20 must expose the photodetector in the beam detect sensor 26 for a shorter period of time than the desired condition illustrated in FIG. 2A. Accordingly, the laser beam 20 must travel a shorter distance along the scan path before the beam detect sensor 26 provides the appropriate signal to the image controller 24, resulting in the horizontal sync pulse 34B being generated at a time in which the laser beam 20 is not as far along the sweep as expected. The difference in position is illustrated in FIG. 2C by the overlap 44C of the horizontal sync pulse 32C and the specified point 40. The horizontal sync pulse 32C starting at an earlier time results in the forward scan 36C being displaced toward the specified point 40. Because the forward scan 36B starts early, the reverse scan 38C also starts early, as depicted by the reverse scan 38C shown shifted to the right in FIG. 2C. Accordingly, the forward scan 36C and the reverse scan 38C are not aligned, thereby degrading the resulting image.

As illustrated in FIGS. 2A, 2B, and 2C, the alignment of the forward and reverse scans 36, 38 is dependant upon the leading edge of the horizontal sync pulse 32 coinciding with a fixed spatial position of the laser beam 20. Variations in the intensity of the laser beam 20 when it is positioned to be sensed by the beam detect sensor 26 can potentially result in misalignment of the forward and reverse scans 36, 38 as illustrated in FIGS. 2B and 2C. The intensity of the laser beam 20 varies for various reasons, including desired intensity variations for darkness control.

Figure 3:
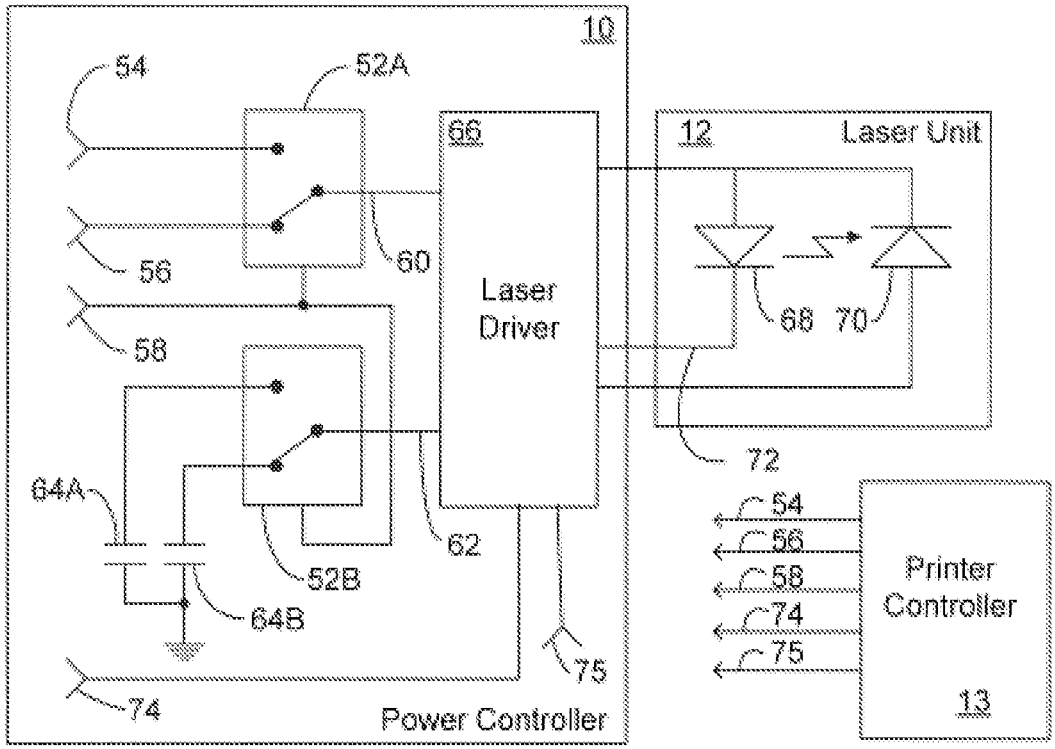
FIG. 3 is a simplified schematic of the power control circuit.
Figure 4:
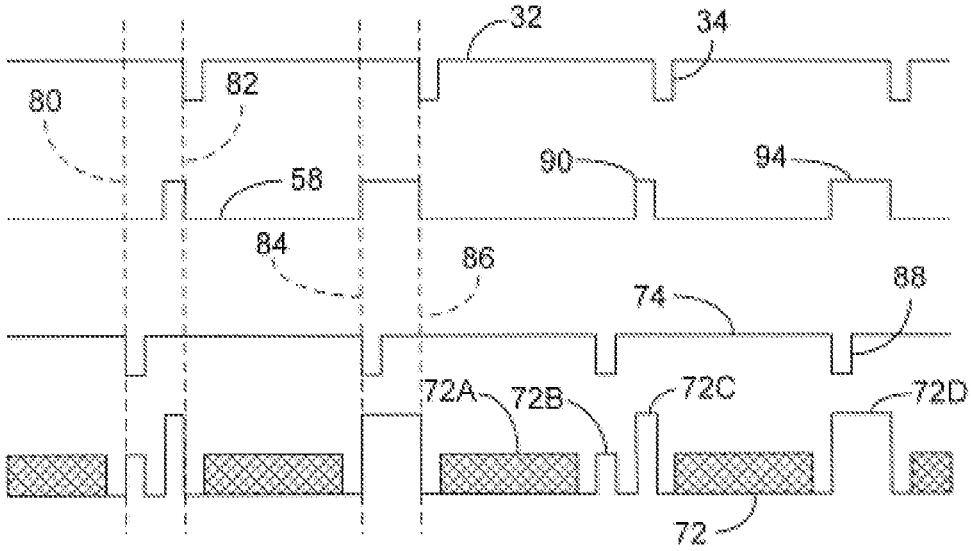
FIG. 4 illustrates the timing and waveforms of four signals within the power control circuit.

FIG. 3 illustrates a simplified schematic of one embodiment of a power control circuit 10, laser unit 12 and printer controller 13. For clarity of illustration, the simplified schematic does not illustrate all the connections associated with the circuit, for example, power and ground connections to the various components. FIG. 4 illustrates the timing and waveforms of four signals within the power control circuit 10.

The power controller 10 includes a laser driver 66, a pair of switches 52A, 52B, and a pair of holding capacitors 64A, 64B. The first switch 52A is the reference power switch and has two inputs, a printing power reference 54 and a beam detect power reference 56. The reference power switch 52A connects one of the two inputs 54, 46 to the reference power level input 60 of the laser driver 66. The reference power switch 52A is actuated by the power select signal 58. When the power select signal 58 has a positive-going pulse 90, 94, the reference power switch 52A connects the beam detect power reference signal 56 to the reference power level 60 input of the laser driver 66. At other times, the printing power reference signal 54 is connected to the reference power level 60 input of the laser driver 66. Even though the switches 52A and B are shown as separate devices (which is acceptable), the switches are typically incorporated into other devices. In this embodiment, the switches would typically be incorporated into the laser driver 66.

The second switch 52B has each of the two inputs connected to a holding capacitor 64A, 64B. The second switch 52B is also actuated by the power select signal 58. When the power selects signal 58 has a positive-going pulse 90-94, the second switch 52B connects the beam detect power reference holding capacitor 64B to hold capacitor input/output, or I/O, port 62 of the laser driver 66. At other times, the printing power reference holding capacitor 64A is connected to the hold capacitor I/O port 62 of the laser driver 66. The power select signal 58 has a regular pattern, with the narrow pulse 90 and the wide pulse 94 alternating and occurring at regular intervals consistent with the adjust pulse 88.

Connected to the laser driver 66 is the laser unit 12, which includes an output laser 68 and a feedback photodiode, or photodetector, 70 optically coupled to the output laser 68. The feedback photodetector 70 is typically a PIN photodiode that is integrated with the output laser 68. The laser driver 66 determines the power of the output laser 68 by monitoring the feedback photodetector 70. When the adjust signal 74 has a low pulse 88, the laser driver 66 determines an error value based on the reference power level 60 and the sensed power of the output laser 68 from the feedback photodetector 70. The error value is then used to set the voltage of the currently selected holding capacitor 64A, 64B. When the adjust signal 74 is at a normal value, that is, when there is no negative-going pulse 88, the laser driver 66 uses the voltage of the currently selected holding capacitor 64A, 64B as a reference level to set the current through the output laser 68. The pulses 88 of the adjust signal 74 occur before the horizontal sync pulses 34, as illustrated by the differences between the reference line pairs 80, 82 and 84, 86.

The signals 54, 56, 58 and 74 are provided by a printer controller 13 that may be located remotely from the laser driver 66. Signal 75 represents all other data and control signals produced by the printer controller 13 and supplied to the power controller 10 (such as the image data signals).

The output laser power signal 72 includes image data 72A, a printing power reference pulse 72B, a narrow beam detect pulse 72C, a wide beam detect pulse 72D. The printing power reference pulse 72B and the two beam detect pulses 72C, 72D are shown with different amplitudes for illustration purposes. Those skilled in the art will recognize that the relative levels may vary depending upon the requirements of the components selected for use. The output laser signal 72 has a two cycle repeating pattern. That is, one cycle includes the image data portion 72A, the printing power reference pulse 72B, and the narrow beam detect pulse 72C. The next cycle includes the image data portion 72A and the wide beam detect pulse 72D. This pattern coincides with the pattern of the power select signal 58, which includes a narrow pulse 90 and a wide pulse 94. The narrow pulse 90 coincides with the output laser power signal 72 portion with the narrow beam detect pulse 72C, and the wide pulse 94 coincides with the output laser power signal 72 portion with the wide beam detect pulse 72D.

The image data 72A portion of the output laser power signal 72 corresponds to one or more of the scans 36, 38 in which data is transferred to the photosensitive drum 22. The intensity, as determined by the output laser 68 output power, of the image data portion 72A is determined by the requirements of the image and may vary throughout the scan 36, 38.

The printing power reference pulse 72B portion of the output laser power signal 72 coincides with every other one of the negative going pulses 88 of the adjust signal 74. Reference line 80 illustrates the relationship between the narrow beam detect pulse 72C and the adjust pulse 88. In the illustrated embodiment, the printing power reference pulse 72B has the same pulse width as the negative going pulse 88 of the adjust signal 74.

The leading edge of the wide beam detect pulse 72D coincides with the leading edge of the other one of the negative going pulses 88 of the adjust signal 74. Reference line 84 illustrates the relationship between the wide beam detect pulse 72D and the adjust pulse 88. In the illustrated embodiment, the wide beam detect pulse 72D has a width wider than the pulse width of the negative going pulse 88 of the adjust signal 74.

FIG. 4 illustrates that the trailing edges of the narrow beam detect pulses 72C and the wide beam detect pulse 72D coincide with the leading edge of the horizontal sync pulse 34. Reference lines 82, 86 illustrates the relationship between the horizontal sync pulses 34 and the beam detect pulses 72C, 72D. In one embodiment, the start of the horizontal sync pulses 34 causes the beam detect pulse 72C, 72D to stop.

The operation of the power control circuit 10 illustrated in FIG. 3 is understood by reference to the timing of the various signals 32, 58, 74, 72 illustrated in FIG. 4. When the output laser power signal 72 includes image data 72A, the first switch 52A is passing the printing power reference signal 54 to the reference power level input 60 of the laser driver 66. A that same time, the second switch 52B connects the printing power reference hold capacitor 64A to the hold capacitor I/O port 62 of the laser driver 66. A short time after the image data 72A stops, the printing power reference pulse 72B portion of the output laser power signal 72 starts at about the same time the adjust pulse 88 starts. The adjust pulse 88 is input to the laser driver 66 and cause the laser driver 66 to determine an error value between the printing power reference signal 54 and the monitored output laser 68 output. The error value is used to adjust the voltage of the printing power reference hold capacitor 64A.

A short time after both the printing power reference pulse 72B and the adjust pulse 88 stop, the narrow beam detect pulse 72C begins. At about the same time, the narrow pulse 90 of the power select signal 58 begins. The narrow pulse 90 of the power select signal 58 causes both of the switches 52A, 52B to change position, connecting the beam detect reference signal 56 to the reference power level input 60 and the beam detect power reference hold capacitor 64B to the hold capacitor I/O port 62 of the laser driver 66. The output laser 68 has its output set to a predetermined power level. The laser beam 20 strikes the beam detect sensor 26 and a horizontal desired sync pulse 34 is generated. The horizontal sync pulse 34 is used by the image controller 24 to sync the appropriate signal and to stop the narrow beam detect pulse 72C. The power select pulse 90 stops at about the same time that the narrow beam detect pulse 72C stops.

After a selected time interval, the output laser power signal 72 includes the next scan of the image data 72A. After the image data 72A is sent, the output laser power signal 72 includes the wide beam detect pulse 72D, which coincides with the wide pulse 94 of the power select signal 58. The wide pulse 94 causes the two switches 52A, 52B to change state so that the beam detect power reference signal 56 is connected to the reference power level input 60 to the laser driver 66 and the beam detect power reference hold capacitor 64B is connected to the hold capacitor I/O port 60 of the laser driver 66. coincide with the leading edge of the wide beam detect pulse 72D of the output laser power signal 72 is the leading edge of an adjust pulse 88. The adjust pulse 88 causes the laser driver 66 to perform an error check of the intensity of the image laser 68 and to adjust the voltage of the beam detect power reference holding capacitor 64B. The adjust pulse 88 has a shorter duration than the wide power select pulse 94 and the wide beam detect pulse 72D; therefore, the wide beam detect pulse 72D continues after the hold capacitor 64B is adjusted. During this later portion of the wide beam detect pulse 72D, the output laser 68 has its output set to a predetermined desired power level. The laser beam 20 strikes the beam detect sensor 26 and a horizontal sync pulse 34 is generated. The horizontal sync pulse 34 is used by the image controller 24 to sync the appropriate signals and to stop the wide beam detect pulse 72D. The wide power select pulse 94 stops when the wide beam detect pulse 72D stops. The above-described two scan cycles of the output laser power signal 72 are repeated, thereby alternating the adjustment of the two holding capacitors 64A, 64B.

Figure 5:
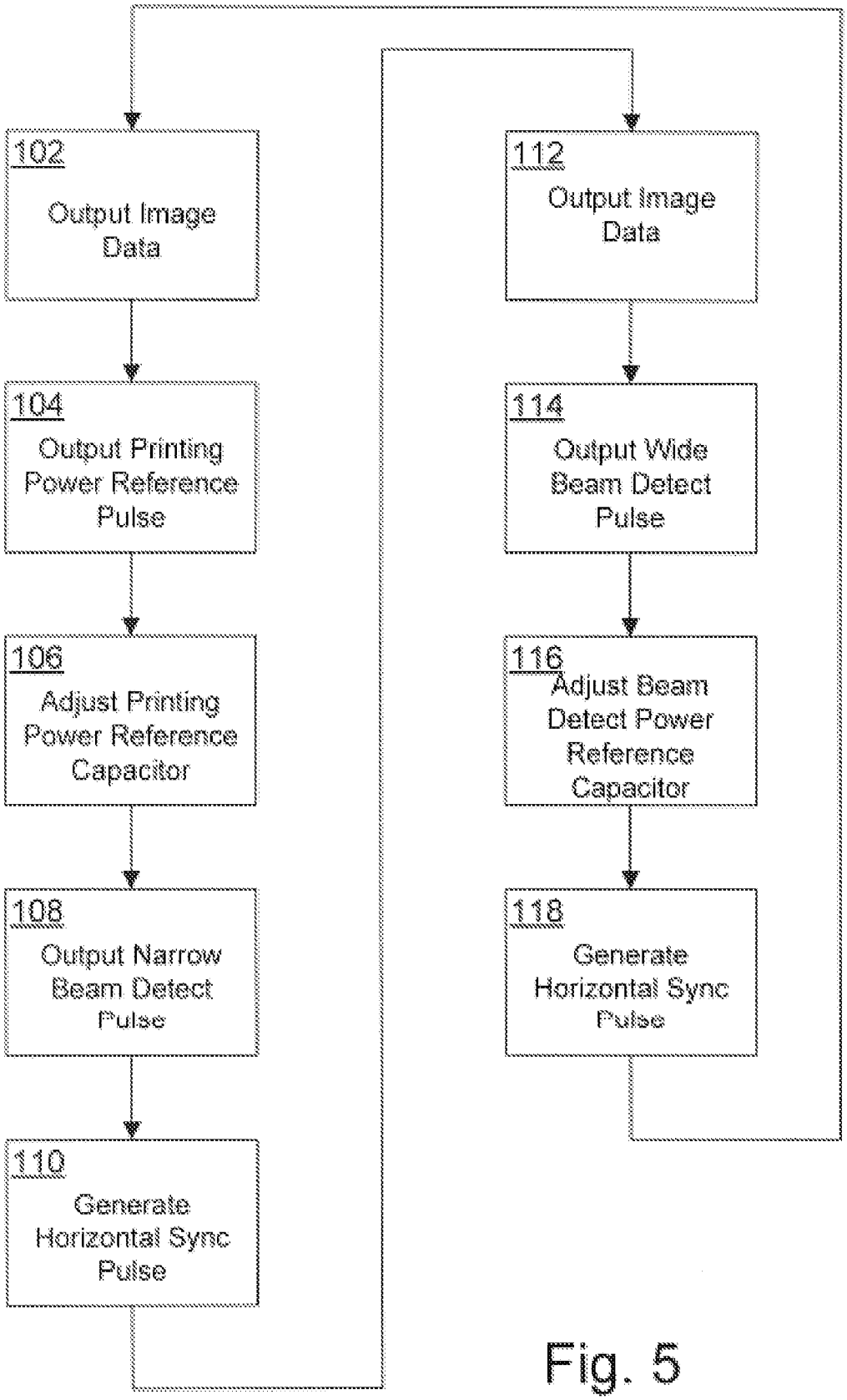
FIG. 5 is a flow diagram of the steps for switching and controlling the output laser power signal.

FIG. 5 is a flow diagram of the steps for switching and controlling the output laser power signal 72. The first step 102 in the repeating loop is to output the image data 72A. The laser driver 66 controls the output laser power signal 72 such that is contains image data 72A. The second step 104 is for the laser driver 66 to output a printing power reference pulse 72B. The third step 106 occurs in conjunction with the previous step 104 in which the printing power reference pulse 72B is being output from the laser driver 66. The third step 106 is to adjust the printing power reference holding capacitor 64A. After the adjustment step 106, the next step 108 is to output a narrow beam detect pulse 72C, which is used in the next step 110 to generate a horizontal sync pulse 34 in the horizontal sync signal 32.

The next step 112 is output the image data 72A for another scan 36, 38. After the image data 72A is output 112, the next step 114 is for the laser driver 66 to output a wide beam detect pulse 72D. The wide beam detect pulse 72D is first used by the next step 116 to adjust the beam detect power reference holding capacitor 64B. After the capacitor 64B is adjusted 116, the wide beam detect pulse 72D is used to generate 118 a horizontal sync pulse 34. After the horizontal sync pulse 34 is generated 118, the loop repeats by outputting 102 another scan of image data 72A.

The power controller 10 includes various functions. The function of switching between a printing power reference signal 54 and a beam detect power reference signal 56 is implemented, in one embodiment, by the first switch 52A. The function of switching between a printing power reference holding capacitor 64A and a beam detect power reference holding capacitor 64B is implemented, in one embodiment, by the second switch 52B. The function of operating the first switch 64A in the tandem with the second switch 64B is implemented, in one embodiment, by the power select pulse 90, 94 of the power select signal 58.

In the above described embodiment, both the forward scan 36A and the reverse scan 36B are timed using a single horizontal sync pulse 32A, and this is an acceptable working embodiment. Other embodiments may include two horizontal sync pulses, one pulse for controlling the forward scan and the other pulse for controlling the timing of the reverse scan. The sync pulses may be created by two different sensors, or one sensor and mirror at the position of the other sensor that reflects the laser beam 20 to the one sensor so that the one sensor creates four sync pulses per cycle (two sync pulses on the forward scan and two sync pulses on the reverse scan).

Figure 6:
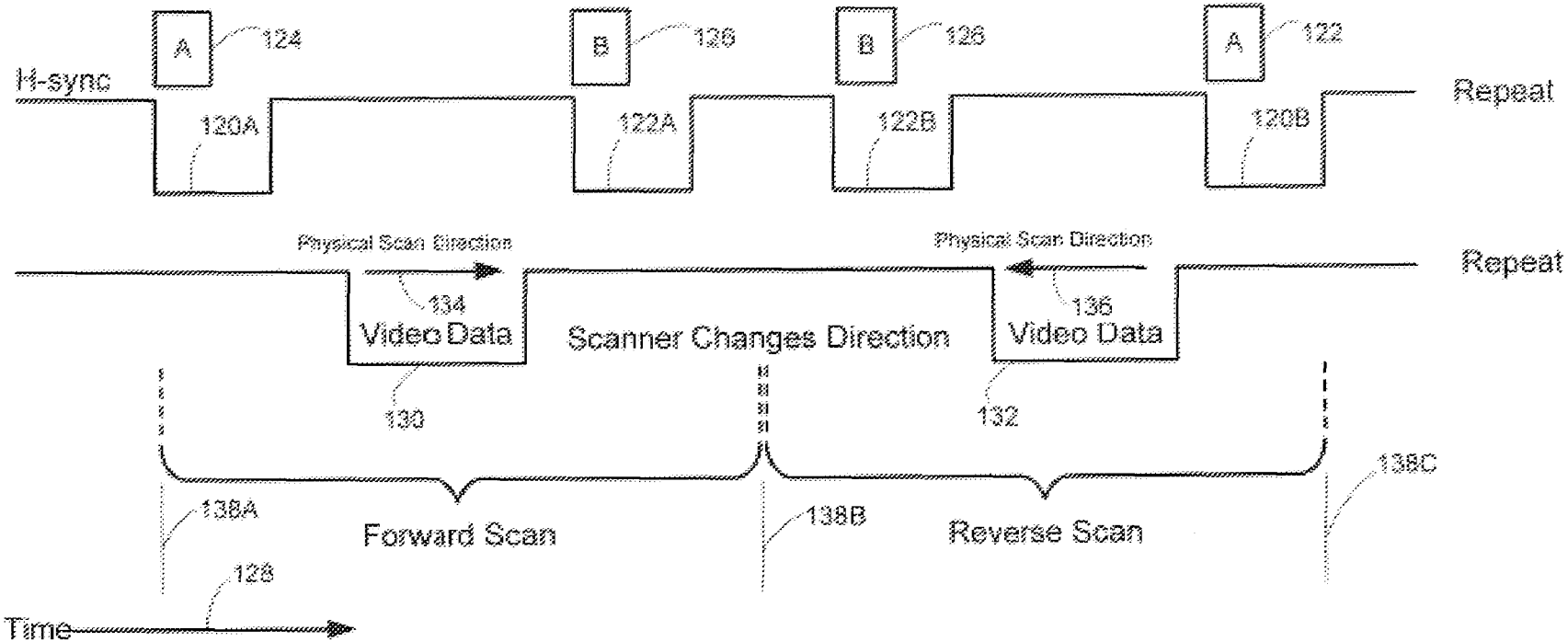
FIG. 6 is a signal waveform diagram illustrating the timing of an example embodiment with two horizontal sync signals in each of the forward and reverse scan directions.

FIG. 6 illustrates the timing of an embodiment with two horizontal sync signals in each scan direction. In this embodiment, horizontal sync pulses 120A and 120B are produced by a first 124 illustrated schematically in FIG. 6, and horizontal sync pulses 122A and 122B are produced by sensor 126 also illustrated schematically in relation to the sync pulses. Sync pulse 120A signifies the start of the forward scan in the sense that the sensor is telling the system that the laser beam 120 is already scanning forward and will soon be in the print zone which is indicated in FIG. 6 by the pulse 130 representing video data (print data). The sync pulse 122A produced by sensor 126 indicates the end of the forward scan, meaning the laser beam 20 is out of the print zone and is approaching a print of reversing direction, which occurs at the position indicated by line 138B. Sync pulse 122B is produced by sensor 126 and indicates the beginning of the reverse scan during which video data 132 will be produced by the laser beam 20. As indicated by arrows 134 and 135, the laser beam 20 is physically traveling in opposite directions during the forward and reverse scans, but FIG. 6 shows time on the horizontal scale, as indicated by arrow 128, to show the timing of the sync pulses and the video data. After the laser beam 20 has left the print zone, it strikes sensor 122 and produces sync pulse 120B indicating the end of the reverse scan of the laser beam 20. Finally, the laser beam 20 reverse directions at line 138C and repeats the cycle starting again at line 138A. The laser beam 20 is positioned at the same place when it reaches lines 138A and 138C, but time has changed.

Figure 7:
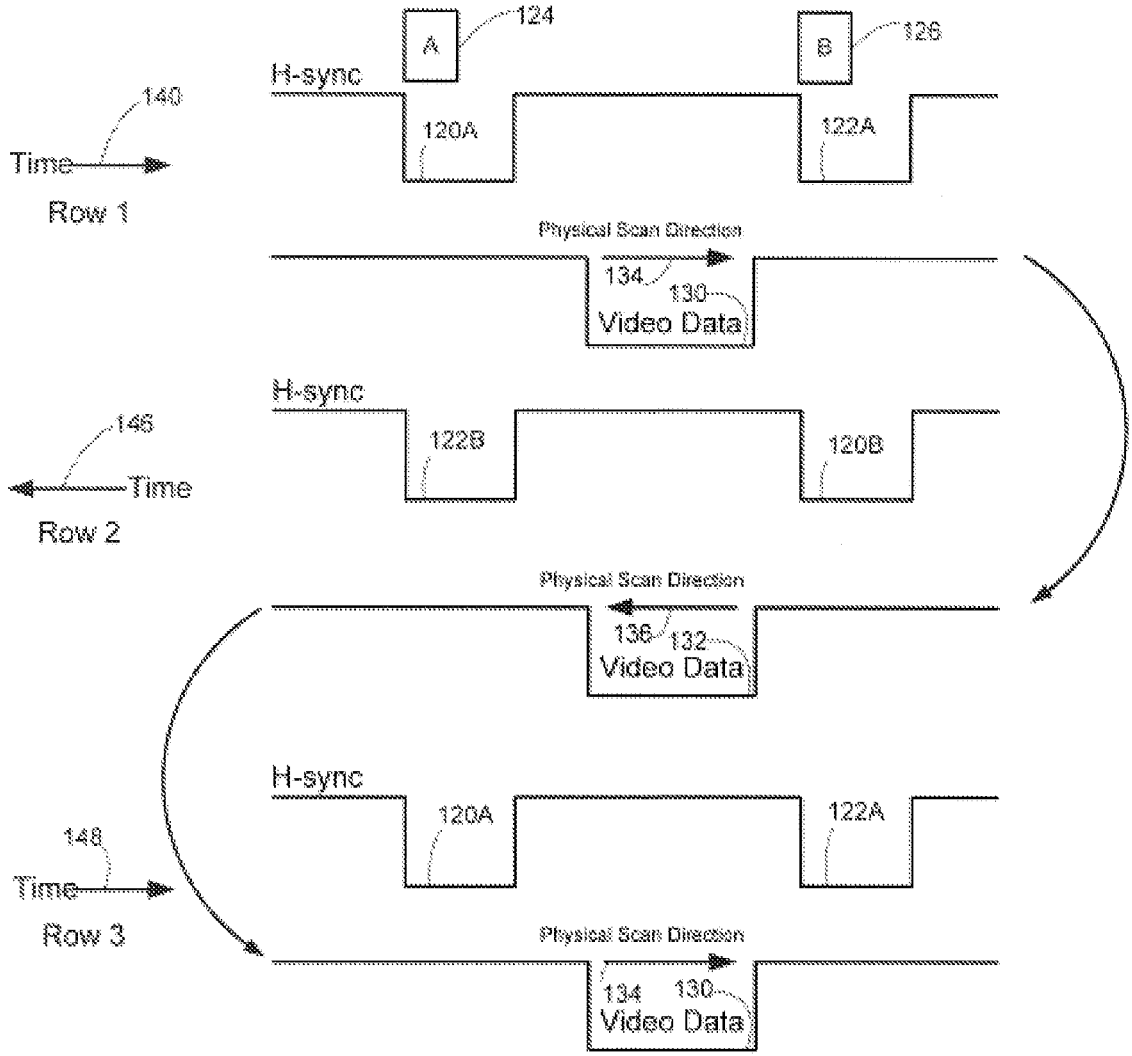
FIG. 7 is a signal waveform diagram illustrating some timing information illustrated in FIG. 6.

FIG. 7 is a spatial illustrated of the same information as shown in FIG. 6, except time is illustrated as progressing in two different directions in FIG. 7. In row 1 of FIG. 7, time progresses to the right as shown by arrow 140, but when the direction of the laser beam 20 changes at row 2, time progresses to the left as indicated by arrow 146. When the laser beam 20 changes directions again at row 3, time again progresses in the right direction as indicated by arrow 148. As illustrated by FIG. 7, the video data at pulses 130 and 132 are aligned spatially in a horizontal direction. Thus, when the video data is used to print, the data is aligned horizontally from print line to print line as the laser beam 20 scans in the forward and reverse directions.

In the embodiment illustrated by FIGS. 6 and 7, the power of the laser beam 20 as it strikes the sensors 124 and 126 is adjusted for each sensor independently using the technique described above with regard to FIGS. 3 and 4. Again, the laser power may be adjusted for each circle at any desired interval, which could be twice per cycle per sensor, since the sensors are stuck twice by the laser beam 20 each cycle.

The foregoing description of preferred embodiments has been presented for purpose of illustration and description. It is not intended to be exhaustive or to limit the invention to the precise form disclosed. Modifications or variations are possible in light of the above teachings. In particular, it should be noted that the power of the laser beam 20 during printing and during beam detect could be changed at different intervals other than the intervals described above. One or both of the power levels could be changed on every scan, every other scan, or every x scan. Likewise, while wide and narrow beam detect pulses are described, the same size beam detect pulses could be used in other embodiments. The embodiment is chosen and described in an effort to provide the best illustration of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A laser scanning apparatus, comprising:

a laser producing a laser beam;

a scanner receiving the laser beam and scanning the laser beam through a scan pattern;

a laser beam detector disposed in the scan pattern for detecting the laser beam and producing a timing signal when the laser beam is detected;

a laser driver connected to the laser for controlling the power of the laser beam produced by the laser;

a reference device for producing a beam detection power reference signal; and the laser driver controlling the laser to produce a laser beam at a predetermined desired power level when the laser beam strikes the laser beam detector, said predetermined desired power level being set by the laser driver based on the beam detection power reference signal;

wherein the reference device further comprises a local power reference device having:

a printing power reference holding capacitor;

a beam detect power reference holding capacitor;

a second switch for selectively connecting one of the printing power reference holding capacitor and the beam detect power reference holding capacitor to the laser driver.

2. The apparatus of claim 1 wherein:

said reference device is a printer controller that produces a printing power reference signal and a beam detect power reference signal; and further comprising an input having a first switch selectively switches between connecting the printing power reference signal and the beam detect power reference signal to said laser driver.

3. The apparatus of claim 1 further comprising:

said reference device comprises a printer controller producing a printing power reference signal and a beam detect power reference signal;

an input including a first switch selectively connecting one of the printing power reference signal and the beam detect power reference signal to said laser driver;

said printer controller producing a power select signal having a repeating series of a narrow pulse and a wide pulse, said power select signal controlling said first switch and said second switch whereby said first switch connects said beam detect power reference signal to said laser driver and said second switch connects said beam detect power reference holding capacitor to said laser driver during a period defined by each of said narrow pulse and said wide pulse.

4. The apparatus of claim 1 wherein the timing signal produced by the laser beam detector is a horizontal sync signal for controlling the timing of image data.

5. The apparatus of claim 1 further including a feedback photodetector connected to said laser driver and optically connected to said laser, said feedback photodetector providing a signal for determining an error value used to set a voltage of one of the printing power reference holding capacitor and the beam detect power reference holding capacitor.

6. The apparatus of claim 1 wherein, the reference device also produces a printing power reference signal, and the laser driver controls the laser to produce the laser beam having a power level based at least in part upon the printing power reference signal.

7. The apparatus of claim 6 wherein the printing power reference signal is provided to the laser driver for use when the scanner sweeps a scan path on a photosensitive drum of the laser scanning apparatus and the beam detect power reference signal is provided to the laser driver for use when the laser beam strikes the laser beam detector.

8. The apparatus of claim 6 wherein the laser driver controls the laser during at least a portion of the scan pattern following the laser beam striking the laser beam detector, having a power level that is based at least in part upon the printing power reference signal.

9. A laser scanning apparatus, comprising:

a laser producing a laser beam;

a scanner receiving the laser beam and scanning the laser beam through a scan pattern;

a laser beam detector disposed in the scan pattern for detecting the laser beam and producing a timing signal when the laser beam is detected;

a laser driver connected to the laser for controlling the power of the laser beam produced by the laser;

a reference device for providing a printing power reference signal and a beam detect power reference signal to the laser driver, the laser driver controlling the power of the laser beam based on the beam detect power reference signal during a first portion of the scan pattern when the laser beam strikes the beam detect sensor and based upon the printing power reference signal during a second portion of the scan pattern; and a beam detect power reference holding capacitor for holding a first voltage corresponding to the beam detect power reference signal and a printing power reference holding capacitor for holding a second voltage corresponding to the printing power reference signal.

10. The apparatus of claim 9 further comprising a first switch for selecting switching between connecting the printing power reference signal and the beam detect power reference signal to the laser driver.

11. The apparatus of claim 9 further comprising a switch for selectively switching between connecting the printing power reference holding capacitor and the beam detect power reference holding capacitor to the laser driver.

12. The apparatus of claim 9 wherein the laser driver is connected to the printing power reference holding capacitor when the laser driver receives the printing power reference signal.

13. The apparatus of claim 9 wherein the laser driver is connected to the beam detect power reference holding capacitor when the laser driver receives the beam detect reference signal.

14. The apparatus of claim 9 further comprising a feedback photodetector connected to the laser driver and optically coupled to the laser, the feedback photodetector sensing the power of the laser beam and providing a feedback signal used for determining an error value between the sensed laser beam power and a selected one of the printing power reference signal and the beam detect power reference signal, the error value being used to set a selected one of the first voltage and the second voltage.

15. The apparatus of claim 9, wherein the second portion of the scan pattern follows in time the first portion thereof.

16. The apparatus of claim 9, wherein the power of the laser beam during at least a portion of the second portion of the scan pattern is also based upon image data.

17. A laser scanning apparatus, comprising:

a laser producing a laser beam;

a scanner receiving the laser beam and scanning the laser beam through a scan pattern;

a laser beam detector disposed in the scan pattern for detecting the laser beam and producing a timing signal when the laser beam is detected;

a laser driver connected to the laser for controlling the power of the laser beam produced by the laser; and controller circuitry coupled to the laser driver for providing to the laser driver a first power reference signal and a second power reference signal such that the power of the laser beam is based upon the first power reference signal during a first portion of the scan pattern and based upon the second power reference signal during a second portion of the scan pattern following the first portion;

wherein the controller circuitry comprises:

a first holding capacitor for holding a first voltage corresponding to the first power reference signal, wherein the laser driver controls the laser to produce the laser beam at a predetermined desired power level when the laser beam strikes the laser beam detector, the redetermined desired power level being set by the laser driver based on the first voltage;

a second holding capacitor for holding a second voltage corresponding to the second power reference signal;

a first switch for selectively connecting one of the first reference signal and the second power reference signal to the laser driver; and a second switch for selectively connecting one of the first holding capacitor and the second holding capacitor to the laser driver.

18. The apparatus of claim 17 further including a feedback photodetector connected to the laser driver and optically connected to the laser, the feedback photodetector providing a signal for determining an error value used to set the voltage of a selected one of the first holding capacitor and the second reference holding capacitor.

19. A laser scanning apparatus, comprising:

a laser producing a laser beam;

a scanner receiving the laser beam and scanning the laser beam through a scan pattern;

a laser beam detector disposed in the scan pattern for detecting the laser beam and producing a timing signal when the laser beam is detected;

a laser driver connected to the laser for controlling the power of the laser beam produced by the laser;

a reference device for producing a beam detection power reference signal;

the laser driver controlling the laser to produce a laser beam at a predetermined desired power level when the laser beam strikes the laser beam detector, said predetermined desired power level being set by the laser driver based on the beam detection power reference signal; and a feedback photodetector connected to said laser driver and optically connected to said laser, said feedback photodetector providing a signal for determining an error value used to set a voltage of one of a printing power reference holding capacitor and a beam detect power reference holding capacitor.

* * * * *